US011939716B2

(12) United States Patent
Ban et al.

(10) Patent No.: US 11,939,716 B2
(45) Date of Patent: Mar. 26, 2024

(54) CLOTHES TREATING APPARATUS

(71) Applicant: LG Electronics Inc., Seoul (KR)

(72) Inventors: Seokhyun Ban, Seoul (KR); Taehee Lee, Seoul (KR); Joonho Pyo, Seoul (KR); Dohyun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 422 days.

(21) Appl. No.: 17/143,763

(22) Filed: Jan. 7, 2021

(65) Prior Publication Data

US 2021/0207313 A1 Jul. 8, 2021

(30) Foreign Application Priority Data

Jan. 7, 2020 (KR) ..... 10-2020-0002227
Feb. 5, 2020 (KR) ..... 10-2020-0013872

(51) Int. Cl.
*D06F 39/08* (2006.01)
*D06F 39/02* (2006.01)

(52) U.S. Cl.
CPC ..... *D06F 39/088* (2013.01); *D06F 39/028* (2013.01); *D06F 39/085* (2013.01)

(58) Field of Classification Search
CPC .... D06F 39/088; D06F 39/028; D06F 39/085; D06F 39/083; F04D 15/0016
(Continued)

(56) References Cited

U.S. PATENT DOCUMENTS 5,768,730 A 6/1998 Matsumoto et al.
5,984,644 A * 11/1999 Yu ..... F04D 29/486 417/423.1

(Continued)

FOREIGN PATENT DOCUMENTS

CN 1133368 A 10/1996
CN 102031679 A 4/2011

(Continued)

OTHER PUBLICATIONS

PCT International Search Report in International Appln. No. PCT/KR2020/015196, dated Jan. 29, 2021, 5 pages (English translation only).

(Continued)

*Primary Examiner* — David G Cormier
*Assistant Examiner* — Thomas Bucci
(74) *Attorney, Agent, or Firm* — Fish & Richardson P.C.

(57) ABSTRACT

Disclosed is a clothes treating apparatus including a drum configured to receive laundry, a tub in which the drum is built, a main body in which the drum and the tub are disposed, detergent drawer compartments provided in the main body to be withdrawn from or inserted in the main body, a spray nozzle configured to spray washing water to the detergent drawer compartments, a water-collecting container disposed below the tub to receive the washing water, a washing line configured to supply the washing water of the water-collecting container to the spray nozzle, a circulation line configured to supply the washing water of the water-collecting container into the drum, and a flow-path conversion pump configured to receive the washing water from the water-collecting container and supply the washing water selectively to the washing line or the circulation line.

14 Claims, 9 Drawing Sheets

(58) Field of Classification Search
USPC ..... 68/23.5
See application file for complete search history.

(56) References Cited

U.S. PATENT DOCUMENTS

| | | | | |
|---|---|---|---|---|
| 6,032,494 | A | 3/2000 | Tanigawa et al. | |
| 2010/0000586 | A1* | 1/2010 | Hendrickson | A47L 15/4214 68/12.18 |
| 2012/0114473 | A1* | 5/2012 | Badafem | F04D 29/486 415/203 |
| 2014/0109323 | A1* | 4/2014 | Kim | D06F 39/086 68/17 R |
| 2014/0286747 | A1* | 9/2014 | Fang | F04D 15/0016 415/206 |
| 2014/0345063 | A1* | 11/2014 | Cavalli | D06F 39/006 68/17 R |

FOREIGN PATENT DOCUMENTS

| | | | | |
|---|---|---|---|---|
| CN | 201832589 | U | 5/2011 | |
| CN | 106350962 | A | 1/2017 | |
| EP | 0145672 | A2 * | 6/1985 | |
| EP | 0460399 | A2 | 11/1991 | |
| GB | 2186325 | A * | 8/1987 | B60S 1/481 |
| JP | H08-82580 | A | 3/1996 | |
| JP | 2007-111410 | A | 5/2007 | |
| KR | 960011218 | U | 4/1996 | |
| KR | 200122430 | | 10/1998 | |
| KR | 100284022 | | 3/2001 | |
| KR | 100347902 | | 8/2002 | |
| KR | 1020050098521 | | 10/2005 | |
| KR | 100698304 | | 3/2007 | |
| KR | 1020090120165 | | 11/2009 | |
| WO | WO 2019/210973 | A1 | 11/2019 | |
| WO | WO-2020088846 | A1 * | 5/2020 | D06F 39/12 |

OTHER PUBLICATIONS

Office Action in Chinese Appln. No. 202080090275.2, dated Mar. 18, 2023, 31 pages (with English translation).
Extended Search Report in European Appln. No. 20912394.4, dated May 17, 2023, 8 pages.

* cited by examiner

CLOTHES TREATING APPARATUS

CROSS-REFERENCE TO RELATED APPLICATIONS

This application claims the benefit of Korean Patent Application No. 10-2020-0002227, filed on Jan. 7, 2020, and Korean Patent Application No. 10-2020-0013872, filed on Feb. 5, 2020, the disclosures of which are incorporated herein in its entirety by reference.

TECHNICAL FIELD

This disclosure relates to an apparatus for treating clothes using a flow-path conversion pump that forms two or more water flows using one motor to use washing water in various ways.

BACKGROUND

In general, a clothes treating apparatus may be a device that launders dirty laundry but also dries laundry by supplying hot air to the laundry that has been washed and spin-dried and evaporating moisture from the laundry. In other words, the clothes treating apparatus may be a device that serves as both washing machine and dryer.

The clothes treating apparatus may have a detergent inlet to put detergents in when operating as a washing machine. Various types of detergents may be used, such as powder detergent, liquid detergent, or fabric softener. Depending on characteristics of these detergents, some detergents may not be fully used during the washing, remain in the detergent inlet, and be accumulated therein, which may cause contamination of laundry. Accordingly, various methods for maintaining the cleanliness of the detergent inlet are studied.

SUMMARY

An aspect is to solve the aforementioned issues and provides a structure for maintaining a cleanliness of a detergent inlet by spraying washing water to the detergent inlet.

Another aspect is to smoothly dissolve a detergent by directly spraying washing water to the detergent inserted into a detergent inlet.

Another aspect provides a structure in which a flow-path conversion pump that autonomously supplies a water flow to a plurality of flow paths is provided to circulate washing water and reuse the washing water for dissolving a detergent or washing a detergent inlet.

Another aspect provides a structure that minimizes a flow loss when changing a flow path of washing water.

Another aspect provides a clothes treating apparatus including a flow-path conversion pump having a minimized number of components and easy to be assembled.

Another aspect provides a clothes treating apparatus including a flow-path conversion pump that prevents leakage occurring in a flow path due to a separation of a diaphragm or prevents water from flowing back to another flow path.

According to an aspect, there is provided a clothes treating apparatus including a drum configured to receive laundry, a tub in which the drum is built, a main body in which the drum and the tub are disposed, detergent drawer compartments provided in the main body to be withdrawn from or inserted in the main body, a spray nozzle configured to spray washing water to the detergent drawer compartments, a water-collecting container disposed below the tub to receive the washing water, a washing line configured to supply the washing water of the water-collecting container to the spray nozzle, a circulation line configured to supply the washing water of the water-collecting container into the drum, and a flow-path conversion pump configured to receive the washing water from the water-collecting container and supply the washing water selectively to the washing line or the circulation line.

The detergent drawer compartments may include a first detergent compartment and a second detergent compartment. The spray nozzle may include a first spray nozzle configured to spray washing water to the first detergent compartment and a second spray nozzle configured to spray washing water to the second detergent compartment.

The flow-path conversion pump may include an impeller housing configured to receive washing water supplied from the water-collecting container, having an impeller built therein, and including a first housing outlet and a second housing outlet formed in parallel with a tangential direction of a rotation of the impeller to correspond to a direction in which the impeller rotates, a flow-path switch having an internal space, including a first inlet and a second inlet respectively communicating with the first housing outlet and the second housing outlet, and including a first outlet and a second outlet respectively communicating with the first inlet and the second inlet, a diaphragm disposed in the internal space of the flow-path switch to separate the first inlet and the second inlet and separate the first outlet and the second outlet, and a motor connected to the impeller to transmit power. The first outlet may be connected to the washing line. The second outlet may be connected to the circulation line.

When viewed from a first direction, the flow-path switch may be in a mortar shape of which a width gradually decreases with respect to a second direction perpendicular to the first direction and increases again at a central portion. When viewed from a third direction perpendicular to the first direction and the second direction, the flow-path switch may be in a circular shape.

A sealing line protruding toward the internal space as a band may be formed in an inner surface of the central portion of the flow-path switch.

The flow-path switch may be formed using two parts based on the diaphragm. When assembling the flow-path switch, an outer portion of the diaphragm may be assembled while being sandwiched to overlap between the two parts.

A portion in which the flow-path switch and the outer portion of the diaphragm overlap may form a closed curve.

The diaphragm may be formed of an elastic material and have a shape in which a central portion of a circular plate protrudes to have a gentle curvature, where a protruding direction is changed by 180 degrees (°) by an external force.

The diaphragm may be formed continuously in a process of protruding from an outermost portion to the central portion, and a curvature may be changed at least once.

The diaphragm may be formed to have a uniform thickness overall, and a coupling portion may be formed at the outermost portion with a thickness greater than that of other portions.

The diaphragm may be disposed to close the first housing outlet, the first inlet, and the first outlet or close the second housing outlet, the second inlet, and the second outlet.

The diaphragm may be formed to have a uniform thickness overall, and a bent portion is formed adjacent to the outermost portion with a thickness less than that of other portions.

When the motor rotates the impeller in a clockwise direction, the diaphragm may protrude in a direction in which the diaphragm blocks the second housing outlet, the second inlet, and the second outlet by a water flow leading to the first housing outlet, the first inlet, and the first outlet.

When the motor rotates the impeller in a counterclockwise direction, the diaphragm may protrude in a direction in which the diaphragm blocks the first housing outlet, the first inlet, and the first outlet by a water flow leading to the second housing outlet, the second inlet, and the second outlet.

According to example embodiments, it is possible to provide a clothes treating apparatus that maintains a cleanliness of a drum by directly spraying washing water to an outer circumferential face of the drum at a high pressure.

According to example embodiments, it is possible to provide a clothes treating apparatus that employs a structure in which a flow path may be changed simply by changing a rotating direction of a motor of a flow-path conversion pump so that washing water can be reused and discharged.

According to example embodiments, it is possible to provide a clothes treating apparatus that minimizes a flow loss of washing water occurring due to a rotation of an impeller by forming a changed flow-path angle to be an obtuse angle.

According to example embodiments, it is possible to provide a clothes treating apparatus in which a diaphragm and a flow-path switch are easily assembled and the flow-path switch is sealed simultaneously with the assembling, which may lead to simplification of a structure.

According to example embodiments, it is possible to provide a clothes treating apparatus that uses a diaphragm previously formed in a specific shape, thereby preventing an elastically deformed state from being maintained continuously.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION

Figure 1:
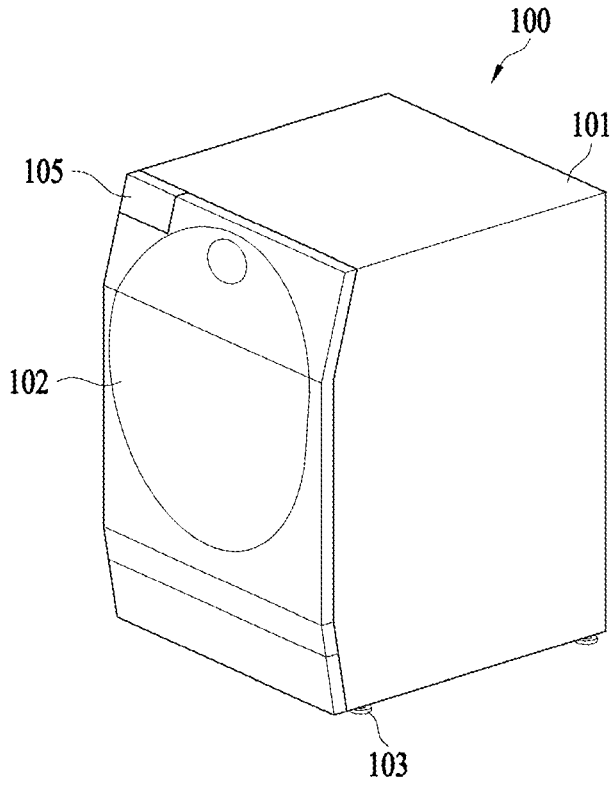
FIG. 1 is a view illustrating an appearance of a clothes treating apparatus according to an example embodiment of the present disclosure.

Hereinafter, some example embodiments disclosed in the present specification will be described in detail with reference to the accompanying drawings, but identical or similar elements are denoted by the same reference numerals regardless of drawing numbers, and redundant descriptions thereof will be omitted. The suffixes "module" and "unit" for components used in the following description are given or used interchangeably in consideration of only the ease of preparation of the specification, and do not have meanings or roles that are distinguished from each other. In addition, in describing the embodiments disclosed in the present specification, when it is determined that a detailed description of related known technologies may obscure the gist of the embodiments disclosed in the present specification, the detailed description thereof will be omitted. In addition, the accompanying drawings are for easy understanding of the embodiments disclosed in the present specification, but the technical idea disclosed in the present specification is not limited by the accompanying drawings, and it should be understood to include all modifications, equivalents, or substitutes included in the spirit and scope of the present invention.

Terms including an ordinal number such as first and second may be used to describe various elements, but the elements are not limited by the terms. These terms are used only for the purpose of distinguishing one component from another component.

When a component is referred to as being "coupled" or "connected" to another component, it should be understood that it may be directly coupled or connected to the other component, but other components may exist in the middle. On the other hand, when a component is referred to as being "directly coupled" or "directly connected" to another component, it should be understood that there is no other component in the middle.

Singular expressions include plural expressions unless the context clearly indicates otherwise.

In the present application, terms such as "comprise" or "have" are intended to designate the presence of features, numbers, steps, actions, components, parts, or combinations thereof described in the specification, but it is to be understood that it does not preclude in advance the possibility of the presence or addition of one or more other features, numbers, steps, actions, components, parts, or combinations thereof.

Figure 2:
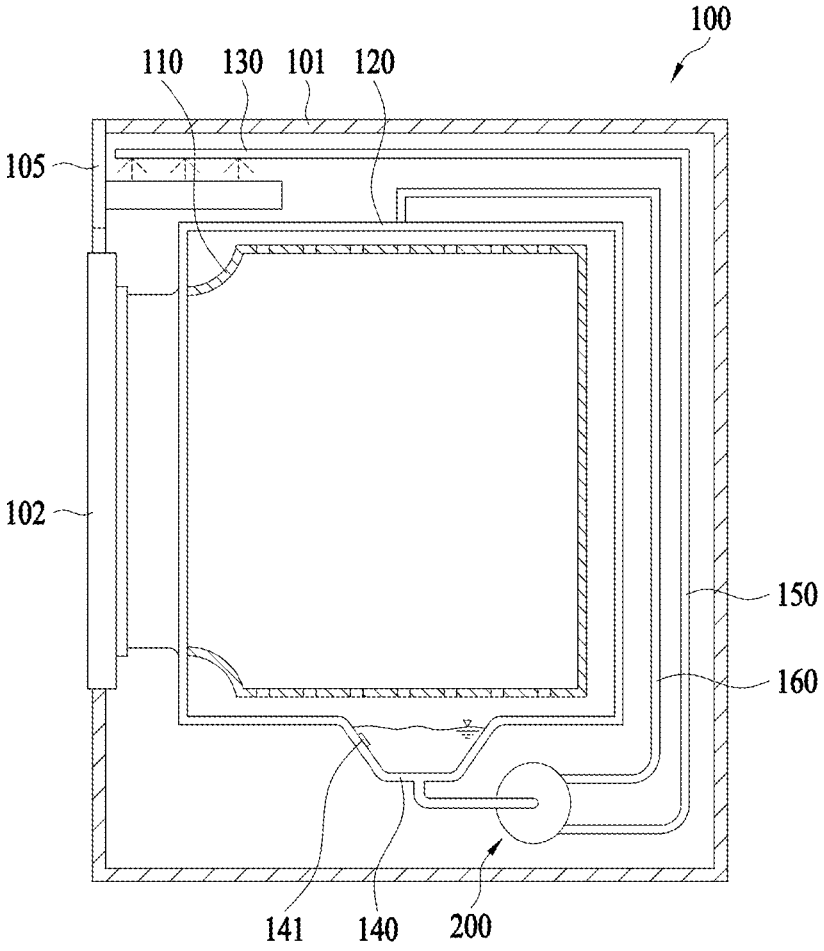
FIG. 2 is a view illustrating a method of supplying cleaning water into detergent drawer compartments of a clothes treating apparatus according to an example embodiment of the present disclosure.

FIG. 1 is a view illustrating an appearance of a clothes treating apparatus 100 according to an example embodiment of the present disclosure and FIG. 2 is a view illustrating a basic operation principle of the clothes treating apparatus 100 according to an example embodiment of the present disclosure.

Referring to FIG. 1, the clothes treating apparatus 100 according to an example embodiment may include a main body 101, a drum 110 (refer to FIG. 2), a tub 120 (refer to FIG. 2), a door 102, and detergent drawer compartments 105.

The main body 101 according to an example embodiment may form an appearance of the clothes treating apparatus 100 and include the drum 110 and the tub 120. Also, the main body 101 may have various built-in components such as a driving motor for rotating the drum 110 and the like.

The drum 110 according to an example embodiment may be rotatably built in the main body 101 and receive laundry. The drum 110 may be rotatably supported by a supporter (not shown) at the front and back.

The tub 120 according to an example embodiment may include the drum 110 and serve to separate internal spaces of the drum 110 and the main body 101. During a washing process, washing water flowing into the drum 110 may be prevented from leaking into the main body 101. Also, during a process of washing the drum 110, the washing water sprayed to an outer circumferential face of the drum 110 may be prevented from leaking into the main body 101.

The door 102 according to an example embodiment may be rotatably installed on a front side of the main body 101 to open and close the front of the drum 110.

The detergent drawer compartments 105 according to an example embodiment may be provided to be withdrawn or inserted at the front side of the main body 101. If a detergent to be used in the washing process is previously put in the detergent drawer compartments 105, the detergent may be automatically applied inside the drum 110 at an appropriate time point in the washing process. For example, if a detergent for pre-washing, a detergent for main washing, or fabric softener for rinsing laundry is inserted, the corresponding detergent may be automatically applied to an inside of the drum 110 at an appropriate time point in the washing process.

In addition, the main body 101 may include a plurality of elastic members (not shown) and a damper (not shown) to support the drum 110 and restrict vibrations and include a driving motor (not shown) to rotate the drum 110.

A flow-path conversion pump (not shown) may be provided below the drum 110 to discharge washing water in the drum 110 to an outside of the drum 110, draw the washing water from the drum 110 to circulate the washing water to an upper area of the drum 110, circulate the washing water to a spray nozzle 130 to dissolve the detergent or wash the detergent drawer compartments, or circulate the washing water to a drum spray nozzle 330 (refer to FIG. 9) to wash the outer circumferential face of the drum 110. Below the clothes treating apparatus 100, a plurality of legs 103 may be disposed to be spaced apart from the ground to support the clothes treating apparatus 100.

A method of supplying washing water into the detergent drawer compartments 105 of the clothes treating apparatus 100 will be described with reference to FIG. 2 as follows.

The clothes treating apparatus 100 according to an example embodiment may include the detergent drawer compartments 105, the spray nozzle 130, a water-collecting container 140, a washing line 150, a circulation line 160, and a flow-path conversion pump 200.

When operating as a washing machine, the clothes treating apparatus 100 according to an example embodiment may wash laundry by rotating the drum 110 after applying washing water and detergents to the laundry accommodated in the drum 110. According to the rotation of the drum 110, the laundry may be washed while contaminants are removed due to shocks and frictions occurring between laundries or between the washing water and the laundry. A rotation direction of the drum 110 may be periodically changed to cause the occurrence of the shocks and frictions between the laundry and the washing water, whereby the contaminants are more effectively removed.

A detergent may be required for the clothes treating apparatus 100 to effectively wash the laundry. The detergent may be inserted into the drum 110 along with the laundry so as to be dissolved by water entering. However, when the detergent is inserted into the drum along with the laundry, the detergent may not evenly spread. In addition, the laundry may be unintentionally damaged at a portion in which the detergent and the laundry contact intensively. Also, if a timing is missed in a process of rinsing the laundry, the washing process may be terminated without adding the fabric softener. Accordingly, the clothes treating apparatus 100 according to an example embodiment may put the required detergent into the detergent drawer compartments 105 so that the detergent is automatically applied to the inside of the drum 110 at an appropriate time point of the washing process.

Although FIG. 2 illustrates that the detergent drawer compartments 105 and the spray nozzle 130 are arranged in an upper portion of the main body 101, it is merely an example, and positions of the detergent drawer compartments 105 and the spray nozzle 130 may be changed based on a position of the detergent drawer compartments 105. In order to help the understanding of the present disclosure, the following description will be given based on a case in which the detergent drawer compartments 105 and the spray nozzle 130 are located in the upper portion of the main body 101.

The detergent drawer compartments 105 according to an example embodiment may be disposed in the upper portion of the main body 101 to be slidably withdrawn from or inserted into the main body 101. A user may withdraw the detergent drawer compartments 105 and previously put a detergent required for the washing process therein. Through this, the missing of the timing for inserting the required detergent may be prevented.

The spray nozzle 130 according to an example embodiment may be disposed to spray the supplied washing water to the detergent drawer compartments 105. When the washing water is sprayed to the detergent in the detergent drawer compartments 105, the detergent may be preliminarily dissolved to flow into the drum. Through this, the detergent may be evenly applied to the laundry, which may prevent a damage to the laundry. For example, when a user uses a powder detergent, the powder detergent may be dissolved by the washing water and then flow into the drum. In this case, the dissolved powder detergent may be evenly applied to the laundry and prevent a damage to the laundry. When the user uses a liquid detergent, the washing water lowers a viscosity of the liquid detergent, it is easy to distribute the detergent evenly in the laundry and possible to prevent a damage to some laundry due to intensively absorption of the detergent. Similarly, when the fabric softener is inserted in the detergent drawer compartments 105, the fabric softener may flow into the drum along with the washing water in a process of rinsing the laundry so as to evenly contact the laundry.

In addition, even when the detergent is absent in the detergent drawer compartments 105, the washing water may be sprayed to the detergent drawer compartments 105 through the spray nozzle 130. During the repeated washing, a small amount of the detergent or fabric softener may remain in the detergent drawer compartments 105 and accumulated therein. Such a remaining detergent may not only contaminate the detergent drawer compartments 105 but may also enter the drum 110 during the washing process and act as contaminants. To prevent this, the spray nozzle 130 may spray the washing water to the detergent drawer compartments 105 at a high pressure so that the detergent drawer compartments 105 is washed.

The washing line 150 according to an example embodiment may connect the water-collecting container 140 and the spray nozzle 130. The circulation line 160 may connect the water-collecting container 140 and an upper area of the drum 110.

The washing water supplied to the drum 110 according to an example embodiment may be received in the water-collecting container 140 under the tub 120. When the washing water is received at a predetermined level or higher, the received washing water may be supplied to the spray nozzle 130 or circulated to the upper area of the drum 110 through the flow-path conversion pump 200 through a sensor 141 embedded in the water-collecting container 140 as described below.

Figure 3:
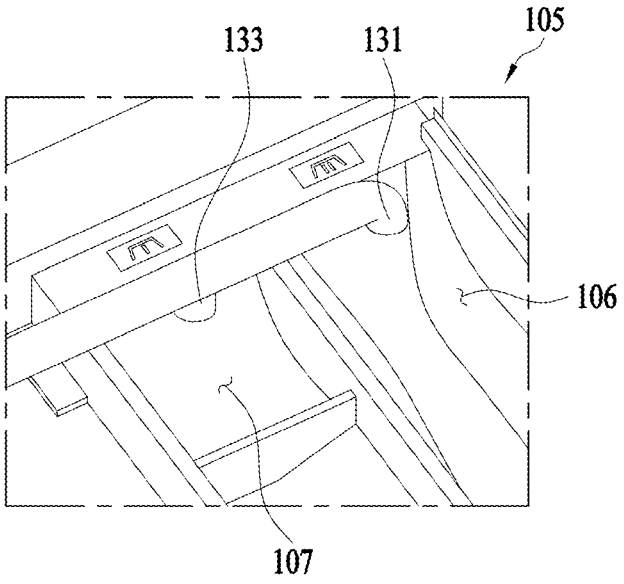
FIG. 3 is a view illustrating detergent drawer compartments of a clothes treating apparatus according to an example embodiment of the present disclosure.

FIG. 3 is a view illustrating a clothes treating apparatus enlarged by focusing on the detergent drawer compartments 105 and the spray nozzle 130 according to an example embodiment.

The detergent drawer compartments 105 according to an example embodiment may include a first detergent compartment and a second detergent compartment 107. Although FIG. 3 illustrates that the detergent drawer compartments 105 include the first detergent compartment 106 and the second detergent compartment 107, it is merely an example, and the detergent drawer compartments 105 may include two or more detergent compartments.

For example, the first detergent compartment 106 may be filled with a detergent for pre-washing, and the second detergent compartment 107 may be filled with a detergent for main washing. In addition, a third detergent compartment may be further provided and filled with a fabric softener required for a laundry rinsing process.

The spray nozzle 130 according to an example embodiment may include a first spray nozzle 131 and a second spray nozzle 133. Like the detergent drawer compartments, the spray nozzle 130 is not limited as including the first spray nozzle 131 and the second spray nozzle 133, and may include two or more spray nozzles based on the number of detergent compartments.

For example, the first spray nozzle 131 may be disposed to spray the washing water to the first detergent compartment 106. Also, the second spray nozzle 133 may be disposed to spray the washing water to the second detergent compartment 107. The spray nozzle 130 according to an example embodiment may receive washing water from the flow-path conversion pump 200 and spray the washing water to the detergent drawer compartments 105. Hence, a spraying pressure of the washing water may be adjusted by adjusting a rotation speed of a motor of the flow-path conversion pump 200.

Figure 4:
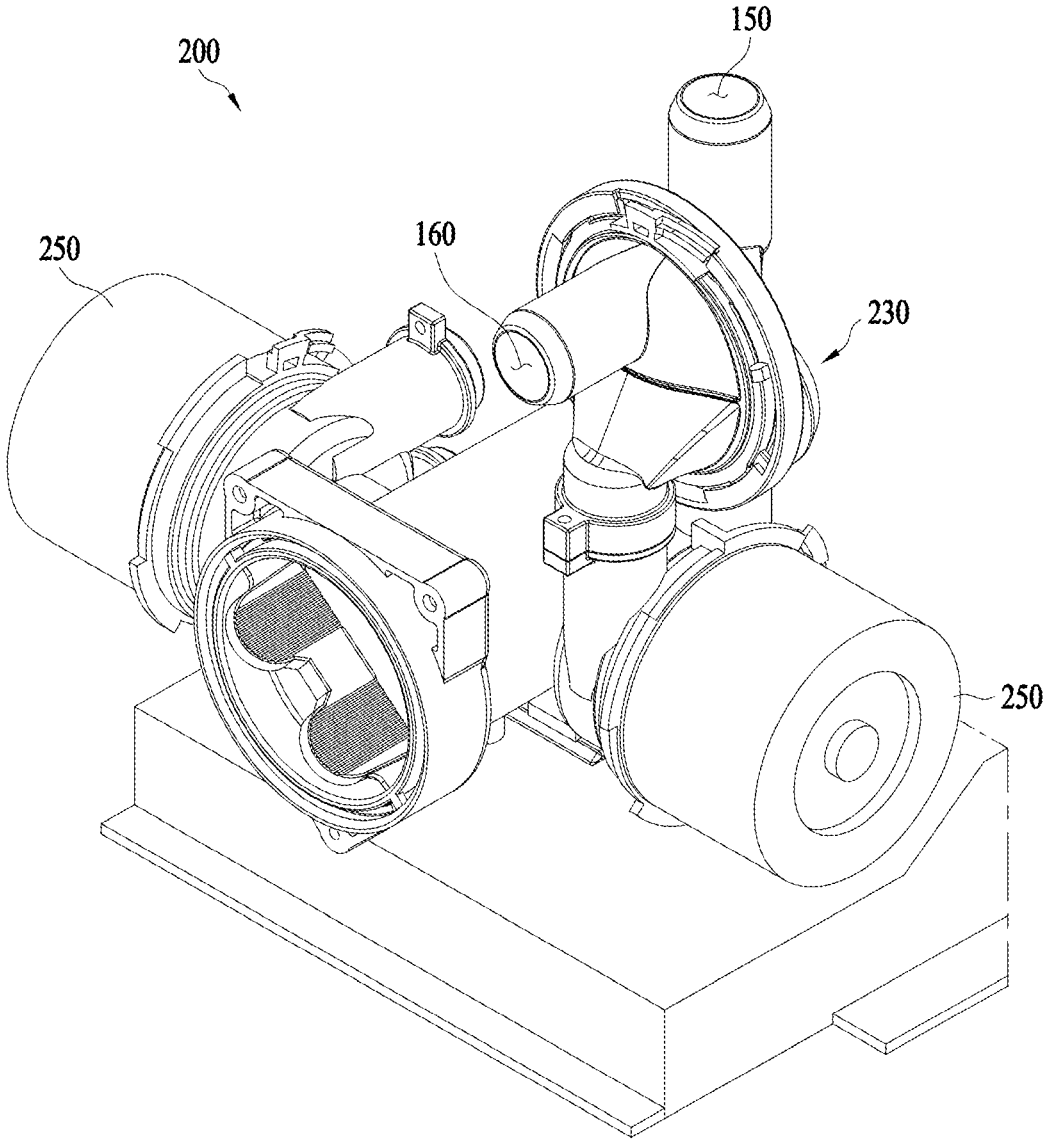
FIG. 4 is a view illustrating a flow-path conversion pump applied to a clothes treating apparatus according to an example embodiment of the present disclosure.

FIG. 4 is a view illustrating the flow-path conversion pump 200 according to an example embodiment of the present disclosure.

The flow-path conversion pump 200 according to an example embodiment may be connected to the water-collecting container 140 to receive washing water and supply the washing water to the washing line 150 or the circulation line 160.

In the foregoing, the flow-path conversion pump that selectively supplies cleaning water or washing water to the washing line 150 or the circulation line 160 has been described with reference to FIG. 2. However, it is merely an example, and embodiments are not limited thereto. For example, the washing line 150 and a drainage line (not shown) discharging washing water to an outside of the main body 101 may be connected to the flow-path conversion pump 200 so that the washing water or cleaning water is supplied selectively. In order to help the understanding of the present disclosure, the following description will be given of a clothes treating apparatus in which water is selectively supplied to the circulation line 160 and the washing line 150 as an example.

As such, in the clothes treating apparatus according to an example embodiment, instead of providing a separate pump for each flow-path required to supply the washing water, a single flow-path conversion pump 200 may be used to generate two flow paths, thereby reducing the number of pumps required therefor.

In describing a clothes treating apparatus 100 according to an example embodiment, "washing water" may refer to water used to remove contaminants from laundry when the clothes treating apparatus 200 operates as a washing machine, and "cleaning water" may refer to washing water or water supplied from an external source to the spray nozzle 130. That is, the washing water may also be used as the cleaning water, and it is not an absolutely distinct concept.

FIG. 4 illustrates an example of the flow-path conversion pump 200 placed in the clothes treating apparatus 100, and a specific appearance may be changed based on a design.

Figure 5:
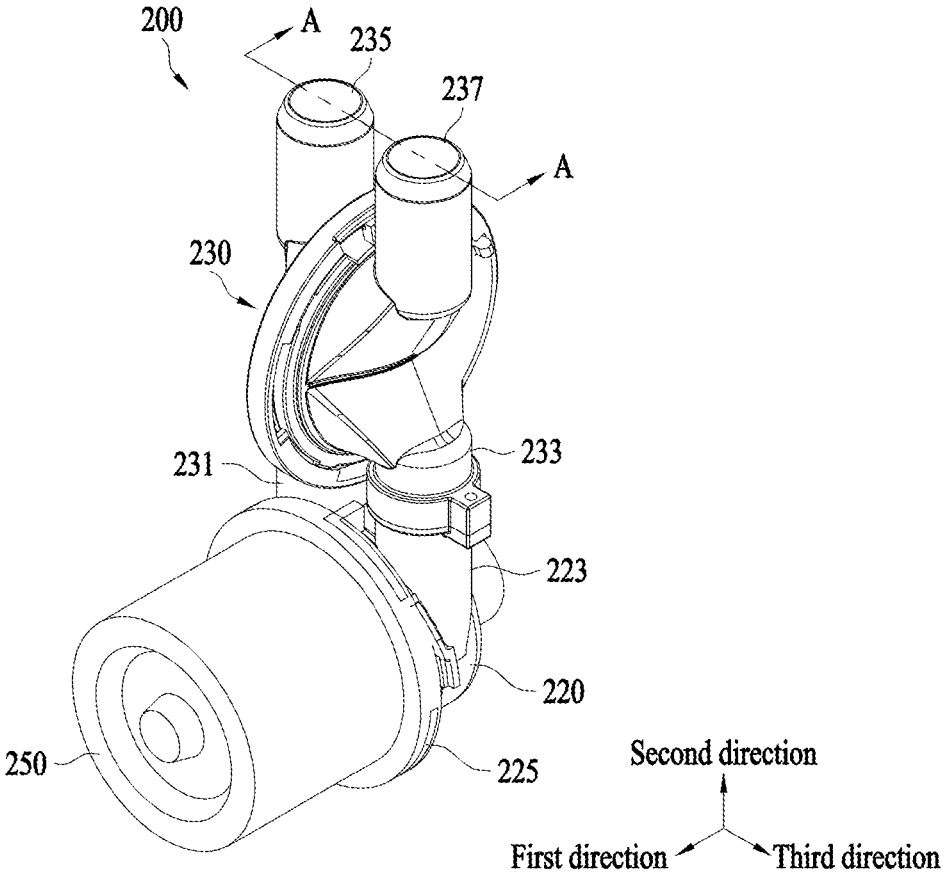
FIG. 5 is a view illustrating a flow-path conversion pump applied to a clothes treating apparatus according to an example embodiment of the present disclosure.
Figure 6:
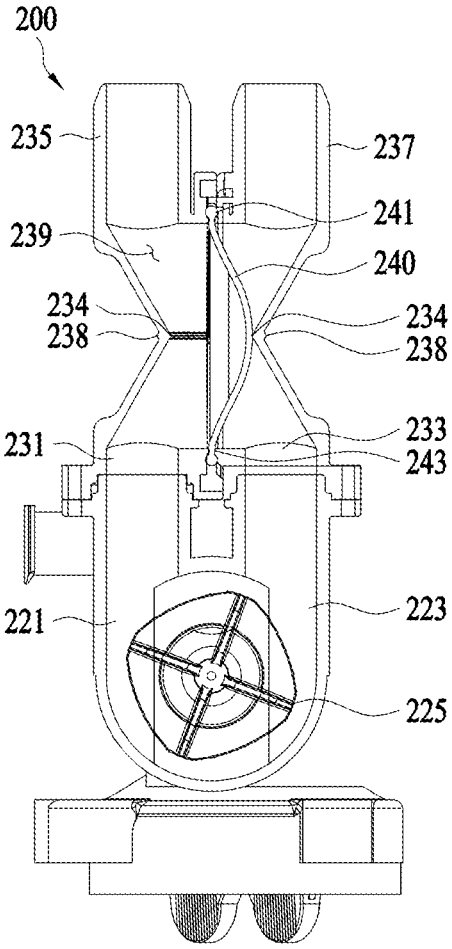
FIG. 6 is a cross-sectional view taken along a line A-A of FIG. 5.

FIG. 5 is a perspective view illustrating the flow-path conversion pump 200 applied to a clothes treating apparatus according to an example embodiment of the present disclosure and FIG. 6 is a cross-sectional view taken along a line A-A of FIG. 5. More specifically, FIG. 5 illustrates a portion (e.g., a case in which water is selectively supplied to the circulation line 160 and the washing line 150) the flow-path conversion pump 200 of FIG. 3.

Referring to FIGS. 5 and 6, the flow-path conversion pump 200 according to an example embodiment of the present disclosure may include an impeller housing 220, a flow-path switch 230, a diaphragm 240, and a motor 250.

Washing water collected in the water-collecting container 140 may flow into the impeller housing 220 according to the example embodiment. The impeller housing 220 may include an impeller 225 connected to the motor 250 and rotating in a predetermined direction. For example, the impeller 225 may rotate in a clockwise direction or a counterclockwise direction based on a rotating direction of the motor 250. Based on a rotating direction of the impeller 225, a flow of the washing water in the flow-path conversion pump 200 may be changed. In addition, the rotating direction and speed of the motor 250 may be controlled so that the motor 250 is operated at a high speed when the washing water is to be sprayed at a high pressure and is operated at a relatively low speed when the washing water is to be sprayed at a relatively low pressure. Through this, unnecessary noise occurrence and power consumption may be prevented. For example, when supplying the washing water to the spray nozzle 130 through the washing line 150, the motor 250 may be operated at a high speed to increase a spraying pressure of the spray nozzle 130. In contrast, when discharging the washing water through the circulation line 160, the motor 250 may be operated at a relatively low speed to prevent unnecessary noise occurrence and power consumption.

The impeller housing 220 according to an example embodiment may include a first housing outlet 221 and a second housing outlet 223. The first housing outlet 221 and the second housing outlet 223 may be formed in parallel in a tangential direction with respect to a rotating direction of the impeller 225. For example, if the first housing outlet 221 is formed parallel to a tangential direction of when the impeller 225 rotates in the clockwise direction, the second housing outlet 223 may be formed in parallel to a tangential direction of when the impeller 225 rotates in the counterclockwise direction. By arranging the first housing outlet 221 and the second housing outlet 223 in parallel in directions tangential to the rotating direction of the impeller 225, a flow loss of the washing water generated by the impeller 225 may be minimized.

The flow-path switch 230 according to an example embodiment may include a first inlet 231, a second inlet 233, a first outlet 235, and a second outlet 237. The first inlet 231 according to an example embodiment may be coupled to communicate with the first housing outlet 221, and the second inlet 233 may be coupled to communicate with the second housing outlet 223. The first inlet 231 and the second inlet 233 may extend along a direction of the first housing outlet 221 and the second housing outlet 223 to be supplied with the washing water while minimizing the flow loss of a water flow generated by the impeller 225. The washing water introduced through the first inlet 231 may be discharged to the first outlet 235 through an internal space 239. As such, a flow path leading to the first housing outlet 221, the first inlet 231, and the first outlet 235 may be defined as a first flow path. In addition, the washing water introduced through the second inlet 233 may be discharged to the second outlet 237 through the internal space 239. As such, a flow path leading to the second housing outlet 223, the second inlet 233, and the second outlet 237 may be defined as a second flow path. The internal space 239 of the flow-path switch 230 may be divided by the below-described diaphragm 240 to prevent the washing water introduced through the first inlet 231 and the washing water introduced through the second inlet 233 from being mixed with each other. Also, the diaphragm 240 may be formed to block the second inlet 233 when the first inlet 231 is opened and block the first inlet 231 when the second inlet 233 is opened. In other words, the diaphragm 240 may be formed to open either the first flow path or the second flow path.

As described above, different water flows may be generated in two flow paths based on the rotating direction of the impeller 225 to supply the washing water, so that one motor 250 serves as two pumps. For example, when the first outlet 235 is connected to the washing line 150 (refer to FIG. 2), the washing water may be supplied to the spray nozzle 130 (refer to FIG. 2). Also, when the second outlet 237 is connected to the circulation line 160 (refer to FIG. 2), the washing water may be discharged to outside the clothes treating apparatus 100 (refer to FIG. 2).

In describing the flow-path conversion pump 200 according to an example embodiment of the present disclosure, a direction may be defined and used to aid understanding. For example, a first direction may be a direction facing the motor 250, the first housing outlet 221, and the second housing outlet 223 simultaneously, which is a direction facing a lower left end based on an illustrated state of FIG. 5. A second direction may be a direction perpendicular to the first direction and facing upward based on the illustrated state of FIG. 5. The third direction may be a direction perpendicular to the first direction and the second direction, which is a lower right direction based on the illustrated state of FIG. 5.

The foregoing direction definitions are only for aiding understanding of the present disclosure and are not absolute, and when one direction reference is changed, the other direction reference may be changed in response thereto.

When viewed from the first direction, the flow-path switch 230 according to an example embodiment may be formed in a mortar shape in which a width decreases gradually and then increases again at a central portion 238 while extending in the second direction. As described above, the flow-path switch 230 may be formed to close one flow path when the other flow path is opened by the built-in diaphragm 240. In this instance, if the flow-path switch 230 is formed to have the same width, when one flow path is opened to close the other flow path, one flow path may be widened. In this case, a large flow loss may occur due to the sudden expansion of the flow path. In addition, the force to pressurize the diaphragm 240 is reduced, so that the force to close the other flow path is insufficient, and the washing water may flow back to the other flow path. Accordingly, in the present disclosure, the width of the central portion 238 of the flow-path switch 230 may be reduced to prevent the flow pressure of the washing water from sudden lowering and maintain the pressure of the diaphragm 240 for closing the flow path on the other side even if the diaphragm 240 opens one flow path and closes the other flow path. For example, the width of the central portion 238 of the flow-path switch 230 may be similar to a width of the first inlet 231 or the second inlet 233. By gradually reducing the width of the central portion 238 of the flow-path switch 230, a drastic change of the flow path may be prevented, thereby minimizing a flow pressure loss of the washing water.

The flow-path switch 230 according to an example embodiment may have a circular shape when viewed from the third direction. The flow-path switch 230 may be formed to correspond to an outer shape of the diaphragm 240 described later and coupled to overlap a portion of an outermost portion 241 of the diaphragm 240. Through this, a path leading to the first housing outlet 221, the first inlet 231, and the first outlet 235 may be distinguished from a path leading to the second housing outlet 223, the second inlet 233, and the second outlet 237.

The diaphragm 240 according to an example embodiment may be circular, formed of a rubber material that is elastically deformable, and have a shape of a circular plate with a protruding central portion having a gentle curvature. The diaphragm 240 may be formed such that the protruding direction is changed by 180 degrees (°) when a force of a certain amount or more is applied to the central portion. For example, when the washing water flows into the first flow path, the central portion of the diaphragm 240 may protrude toward the second flow path due to the flow pressure and contact the central portion 238 of the flow-path switch 230 to block the second housing outlet 223. A degree of protrusion of the central portion of the diaphragm 240 may be the extent to block the first housing outlet 221 or the second housing outlet 223. For example, the central portion of the diaphragm 240 may contact a sealing line 234 or protrude to be pressed by a predetermined degree. As the central portion of the diaphragm 240 protrudes while forming a gentle curvature, and the flow-path switch 230 is gradually widened again from the central portion 238 toward the second direction, the flow loss of the washing water may be minimized.

Figure 7:
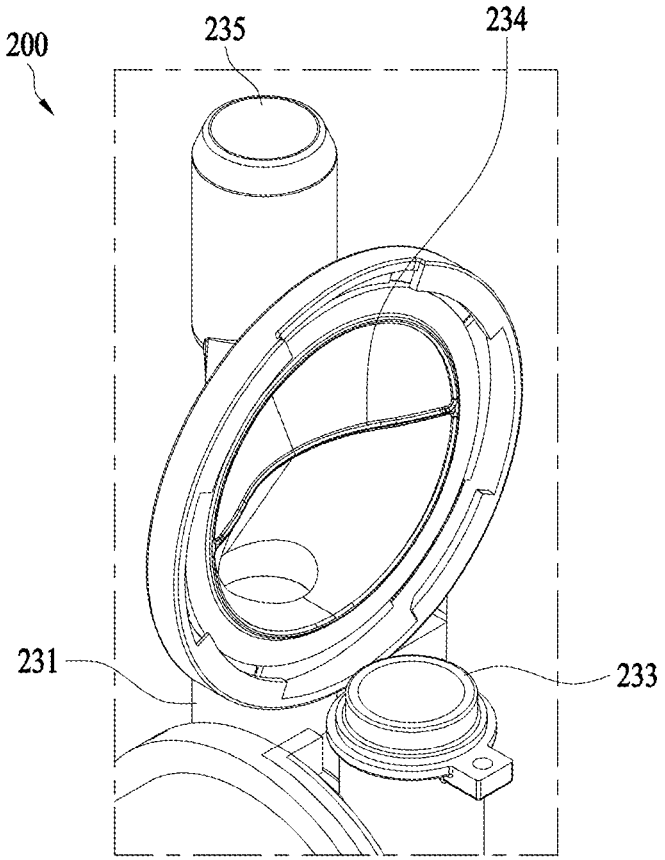
FIG. 7 is a view illustrating an interior of a flow-path switch applied to a clothes treating apparatus according to an example embodiment of the present disclosure.

FIG. 7 is a view illustrating an interior of the flow path switch 230 applied to a clothes treating apparatus according to an example embodiment of the present disclosure. More specifically, FIG. 7 illustrates the flow-path switch 230 with omitting some components therein.

According to an example embodiment, the flow-path switch 230 may be divided into two parts based on the diaphragm 240. For example, the flow-path switch 230 may be divided into a part forming a first flow path and a part forming a second flow path. The flow-path switch 230 may be coupled with the diaphragm 240 interposed therebetween to overlap a portion of the outermost portion 241 of the diaphragm 240. An overlapping portion between the flow-path switch 230 and the outermost portion 241 of the diaphragm 240 may form a closed curve. As such, when coupled with the diaphragm 240 to overlap a portion of the outermost portion 241, the first flow path and the second flow path may be separated and simultaneously, a coupled portion of the two parts may be sealed to prevent leakage. The flow-path switch 230 may be assembled by rotating two parts circularly formed to interpose the diaphragm 240 therebetween while the two parts are in contact with each other. However, it is merely an example, and any method of combining two parts may be applied in various ways.

The sealing line 234 may be formed on an inner surface of the central portion 238 of the flow-path switch 230. The sealing line 234 may protrude from an inner surface of the central portion 238 with forming a band, and may form a ring shape when the two parts of the flow-path switch 230 are assembled. The sealing line 234 may be formed to correspond to a protruding shape of the diaphragm 240. As described above, the sealing line 234 and the diaphragm 240 may be in line contact with each other, or in contact with each other such that a central portion of the diaphragm 240 is pressed by a predetermined degree.

Figure 8A:
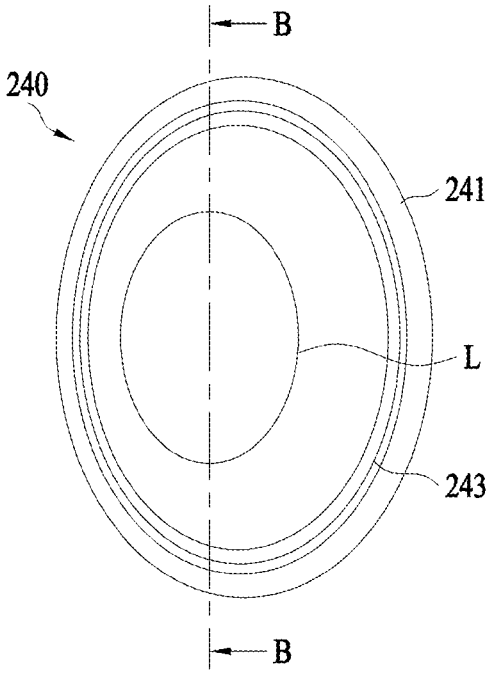
FIGS. 8A and 8B are views illustrating a diaphragm of a flow-path conversion pump applied to a clothes treating apparatus according to an example embodiment of the present disclosure.
Figure 8B:
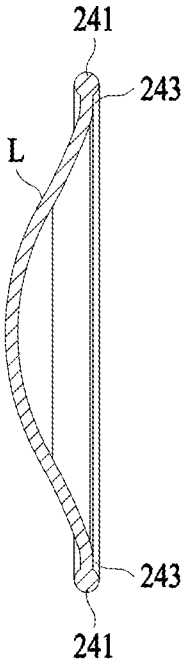

FIGS. 8A and 8B are views illustrating the diaphragm 240 applied to a clothes treating apparatus according to an example embodiment of the present disclosure. More specifically, FIG. 8A is a perspective view of the diaphragm 240 and FIG. 8B is a cross-sectional view taken along a ling B-B of FIG. 8A.

Referring to FIGS. 8A and 8B, the diaphragm 240 according to an example embodiment may be formed of a rubber material that is elastically deformable, and may have a shape of a circular plate with a protruding central portion forming a gentle curvature. The diaphragm 240 may be pre-formed to maintain the protruding shape of the central portion. Also, the diaphragm 240 may be formed such that the protruding direction is changed by 180° when a force of a certain amount or more is applied to the central portion. As the diaphragm 240 maintains a protruding state in one direction, either side of the first flow path or the second flow path may be closed and the other side may be open. By pre-forming the diaphragm 240 to close one flow path, it is possible to significantly reduce a flow pressure of washing water required to close a flow path on one side. Through this, it is possible to increase a durability of the diaphragm 240, more reliably close the flow path of any one side, and prevent a reverse flow of the washing water. The central portion of the diaphragm 240 may protrude while forming a gentle curvature in a continuous shape. In this instance, a curvature may be changed at least once. For example, the central portion may be deformed so that a protruding amount of the central portion decreases with respect to a reference line L shown in FIGS. 8A and 8B. In the outermost portion 241 of the diaphragm 240, a curvature may be formed sufficiently large to protrude radically so that the amount of protrusion is larger than that of the central portion. Through this, a change in the protruding direction of the diaphragm 240 may be made more clearly. In the central portion of the diaphragm 240, the curvature may be formed to be relatively small so that the amount of protrusion is relatively small, so that a change in the first flow path or the second flow path is made as smooth as possible, thereby minimizing flow loss.

The diaphragm 240 according to an example embodiment may be formed to have a uniform thickness overall. In the outermost portion 241, a coupling portion 241 may be formed to have a thickness greater than that of another portion. As described above, the flow-path switch 230 may be coupled with the diaphragm 240 interposed therebetween to overlap a portion of the outermost portion 241 of the diaphragm 240 so that a coupling portion of the two parts are sealed to prevent leakage. Accordingly, the durability and sealing force of the diaphragm 240 may be increased by forming a thick overlapping portion of the outermost portion 241. According to the example embodiment, in a vicinity of the outermost portion 241 of the diaphragm 240, a bent portion 243 may be formed to have a thickness less than that of another portion. Particularly, the diaphragm 240 may be formed to be converted by a flow pressure of the washing water flowing through the first flow path or the second flow path without having a separate actuator for changing the protruding direction. As described above, a rotational speed of the motor 250 may be controlled so that the motor 150 is controlled to rotate quickly when draining and to rotate relatively slowly during circulation. When the motor 250 rotates slowly, the flow pressure of the washing water may be lowered. Even in this case, a thin portion such as the bent portion 243 may be provided to facilitate the conversion of the protruding direction of the diaphragm 240.

Figure 9:
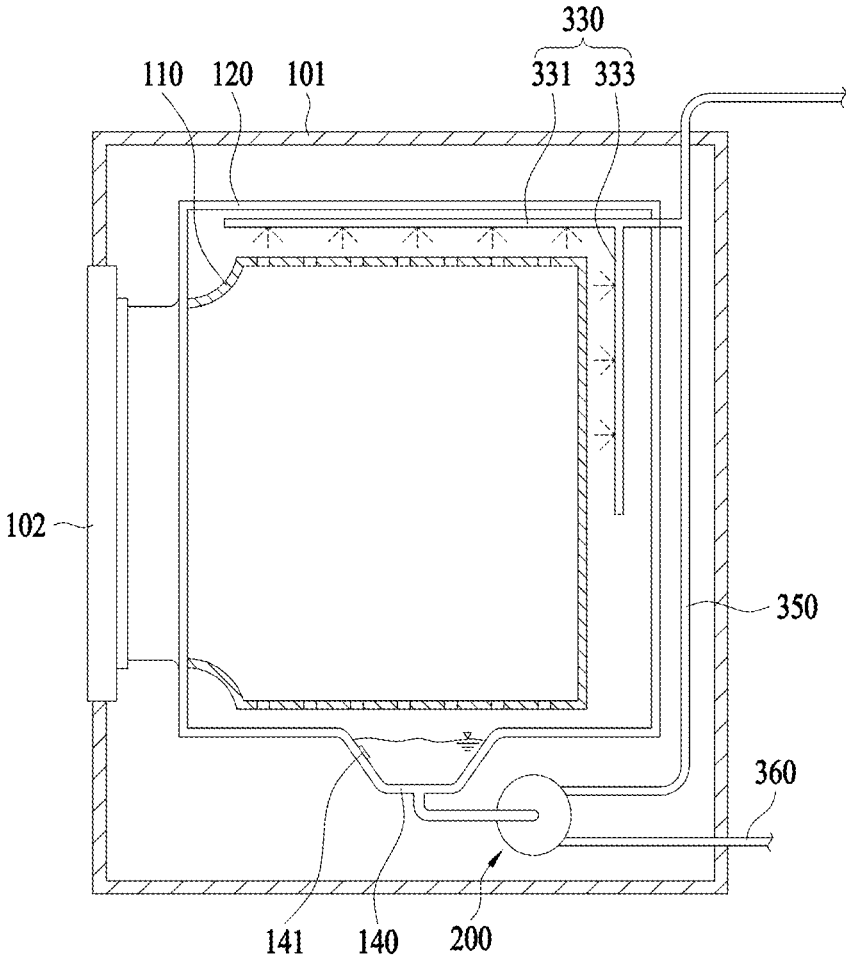
FIG. 9 is a view illustrating a drum washing method of a clothes treating apparatus according to another example embodiment of the present disclosure.

FIG. 9 is a view illustrating a drum washing method of a clothes treating apparatus 100 according to another example embodiment of the present disclosure.

The clothes treating apparatus 100 according to another example embodiment may include a drum spray nozzle 330, a water-collecting container 140, a second washing line 350, a drainage line 360, and a flow-path conversion pump 200.

When operating as a washing machine, the clothes treating apparatus 100 according to another example embodiment may wash laundry by rotating the drum 110 after applying washing water and detergents to the laundry accommodated in the drum 110. According to the rotation of the drum 110, the laundry may be washed while contaminants are removed due to frictions occurring between laundries or between the washing water and the laundry. A rotation direction of the drum 110 may be periodically changed so that the contaminants are more effectively removed.

When operating as a drying machine, the clothes treating apparatus 100 according to another example embodiment may remove moisture of an object to be dried by continuously circulating hot and dry air to the object inserted into the drum 110. The hot and dry air may be supplied using a heat pump cycle or generated using an electric heater.

As such, when the clothes treating apparatus 100 operates as the washing machine, the contaminants removed from the laundry may be discharged along with the washing water. However, during the repeated washing process, some contaminants may not be discharged and may remain and accumulate between the drum 110 and the tub 120. In particular, due to the characteristic that the washing water and the contaminants are discharged through a bottom of the drum 110, some contaminants floating on an upper surface of the washing water may cling onto the drum 110 and be accumulated.

In addition, when the clothes treating apparatus 100 operates as a drying machine, dust generated from clothes as the laundry is dried may remain and accumulate between the drum 110 and the tub 120 in a circulation process of the hot air. The dust accumulated in the tub 120 may be washed and removed in a process of discharging the washing water, but it may be difficult to remove containments accumulated on an outer face of the drum 110.

To solve this, in the clothes treating apparatus 100 according to another example embodiment, the drum spray nozzle 330 may be disposed between the drum 110 and the tub 120 the tub 120. The drum spray nozzle 330 may spray the washing water to the outer face of the drum 110 or an inner face of the tub 120 at the high pressure so as to remove the accumulated contaminants.

Although FIG. 9 illustrates that the drum spray nozzle 330 is disposed to spray the washing water toward the drum 110, it is merely an example, and the drum spray nozzle 330 may also be disposed to spray the washing water toward an inner circumferential face of the tub 120. However, in order to help the understanding of the present disclosure, the following description is given based on a case in which the washing water is sprayed to the outer face of the drum 110.

The drum spray nozzle 330 according to another example embodiment may include a first drum spray nozzle 331 and a second drum spray nozzle 333. For example, the first drum spray nozzle 331 may be disposed to spray the washing water to the outer circumferential face of the drum 110, and the second drum spray nozzle 333 may be disposed to spray the washing water to a rear face of the drum 110. The drum spray nozzle 330 according to another example embodiment may receive washing water from the flow-path conversion pump 200 and spray the washing water to the outer face of the drum 110. The flow-path conversion pump 200 may adjust a spraying pressure of the washing water by adjusting a rotation speed of a motor.

The second washing line 350 according to another example embodiment may connect the water-collecting container 140 and the drum spray nozzle 330. The drainage line 360 may connect the water-collecting container 140 and a drainage hole.

The washing water sprayed to the outer face of the drum 110 according to another example embodiment may be collected in the water-collecting container 140 below the tub 120. When the washing water is received at a predetermined level or higher, the received washing water may be supplied to the drum spray nozzle 330 or discharged to an outside of the flow-path conversion pump 200 through the sensor 141 embedded in the water-collecting container 140.

It will be apparent to those skilled in the art that various modifications and variations can be made in the present disclosure without departing from the spirit or scope of the disclosure.

The above detailed description should not be construed as restrictive in all respects and should be considered as illustrative. The scope of the present disclosure should be determined by reasonable interpretation of the appended claims, and all modifications within the equivalent scope of the present disclosure are included in the scope of the present disclosure.

What is claimed is:

1. A clothes treating apparatus comprising:

a drum configured to receive laundry;

a tub that accommodates the drum;

a main body that accommodates the tub;

a detergent drawer configured to be withdrawn from and inserted into the main body;

a spray nozzle configured to spray washing water to the detergent drawer;

a water-collecting container formed in a bottom portion of the tub and configured to receive the washing water;

a washing line configured to supply the washing water from the water-collecting container to the spray nozzle;

a circulation line configured to supply the washing water from the water-collecting container to the drum; and a flow-path conversion pump configured to receive the washing water from the water-collecting container and to supply the washing water selectively to the washing line or the circulation line, wherein the flow-path conversion pump comprises:

an impeller, a motor connected to the impeller and configured to transmit power to the impeller, an impeller housing that accommodates the impeller and is configured to receive the washing water from the water-collecting container, the impeller housing defining a first housing outlet and a second housing outlet that extend parallel to a tangential direction of rotation of the impeller, a flow-path switch that defines an internal space, the flow-path switch comprising (i) a first inlet configured to communicate with the first housing outlet, (ii) a second inlet configured to communicate with the second housing outlet, (iii) a first outlet configured to communicate with the first inlet and connected to the washing line, and (iv) a second outlet configured to communicate with the second inlet and connected to the circulation line, and a diaphragm that is disposed in the internal space of the flow-path switch, that separates the first inlet and the second inlet from each other, and that separates the first outlet and the second outlet from each other, wherein the diaphragm is made of an elastic material, has a shape in which a central portion of a circular plate protrudes to have a curvature, and is pre-formed to maintain the protruding shape of the central portion, wherein a protruding direction of the central portion of the diaphragm is configured to be changed by 180 degrees (°) based on an external force, and the changed protruding direction of the central portion of the diaphragm is configured to be maintained based on the external force being eliminated, and wherein the diaphragm is configured to respectively open and close flow paths of the washing water in the flow-path switch based on the protruding direction of the diaphragm being changed.

2. The clothes treating apparatus of claim 1, wherein the detergent drawer comprises a first detergent compartment and a second detergent compartment, and wherein the spray nozzle comprises a first spray nozzle configured to spray the washing water to the first detergent compartment, and a second spray nozzle configured to spray the washing water to the second detergent compartment.

3. The clothes treating apparatus of claim 1, wherein when viewed from a first direction, a width of the flow-path switch decreases along a second direction from a first portion to a central portion, and increases from the central portion to a second portion away from the central portion, the central portion being disposed between the first portion and the second portion in the second direction, and when viewed from a third direction perpendicular to the first direction and the second direction, the flow-path switch is in a circular shape.

4. The clothes treating apparatus of claim 3, wherein a sealing line protruding toward the internal space as a band is formed in an inner surface of the central portion of the flow-path switch.

5. The clothes treating apparatus of claim 1, wherein the flow-path switch comprises a pair of parts that are coupled to each other to define the internal space, and wherein an outer portion of the diaphragm is coupled between the pair of parts of the flow-path switch.

6. The clothes treating apparatus of claim 5, wherein the outer portion of the diaphragm overlaps with the pair of parts of the flow-path switch and defines a closed curve.

7. The clothes treating apparatus of claim 1, wherein the diaphragm extends from an outermost portion to the central portion, and defines one or more curvatures.

8. The clothes treating apparatus of claim 7, wherein the diaphragm comprises a coupling portion disposed at the outermost portion, and wherein a thickness of the coupling portion is greater than a thickness of other portions of the diaphragm.

9. The clothes treating apparatus of claim 8, wherein the diaphragm is configured to:

based on bending in a first direction, close the first housing outlet, the first inlet, and the first outlet; and based on bending in a second direction opposite to the first direction, close the second housing outlet, the second inlet, and the second outlet.

10. The clothes treating apparatus of claim 8, wherein the diaphragm comprises a bent portion disposed adjacent to the outermost portion, and wherein a thickness of the bent portion is less than the thickness of the other portions of the diaphragm.

11. The clothes treating apparatus of claim 1, wherein when the motor rotates the impeller in a clockwise direction, the diaphragm protrudes in a direction in which the diaphragm blocks the second housing outlet, the second inlet, and the second outlet by a water flow leading to the first housing outlet, the first inlet, and the first outlet.

12. The clothes treating apparatus of claim 1, wherein when the motor rotates the impeller in a counterclockwise direction, the diaphragm protrudes in a direction in which the diaphragm blocks the first housing outlet, the first inlet, and the first outlet by a water flow leading to the second housing outlet, the second inlet, and the second outlet.

13. The clothes treating apparatus of claim 1, wherein the flow paths in the flow-path switch include:

a first flow path defined between the first inlet and the first outlet; and a second flow path defined between the second inlet and the second outlet, wherein the diaphragm is configured to:

open the first flow path and close the second flow paths based on the protruding direction of the diaphragm being changed to the second flow path, and close the first flow path and open the second flow paths based on the protruding direction of the diaphragm being changed to the first flow path.

14. The clothes treating apparatus of claim 1, wherein the diaphragm is disposed between the first inlet and the second inlet and between the first outlet and the second outlet such that the diaphragm partitions (i) a first side of the internal space of the flow-path switch into the first inlet and the second inlet and (ii) a second side of the internal space of the flow-path switch into the first outlet and the second outlet.

* * * * *